US011098539B2

(12) United States Patent
Guan et al.

(10) Patent No.: US 11,098,539 B2
(45) Date of Patent: Aug. 24, 2021

(54) PASSIVE HEAVE COMPENSATOR

(71) Applicant: Dalian University of Technology, Dalian (CN)

(72) Inventors: Guan Guan, Dalian (CN); Lei Wang, Dalian (CN); Yunlong Wang, Dalian (CN); Chaoguang Jin, Dalian (CN); Ming Chen, Dalian (CN); Xiaole Yang, Dalian (CN)

(73) Assignee: DALIAN UNIVERSITY OF TECHNOLOGY, Dalian (CN)

( * ) Notice: Subject to any disclaimer, the term of this patent is extended or adjusted under 35 U.S.C. 154(b) by 0 days.

(21) Appl. No.: 16/882,570

(22) Filed: May 25, 2020

(65) Prior Publication Data

US 2021/0087892 A1 Mar. 25, 2021

(30) Foreign Application Priority Data

Sep. 25, 2019 (CN) ..... 201910909820.5

(51) Int. Cl.

| | |
|---|---|
| ***E21B 19/00*** | (2006.01) |
| ***B63B 21/50*** | (2006.01) |
| ***B63B 35/44*** | (2006.01) |
| *E21B 19/09* | (2006.01) |
| *B63B 21/00* | (2006.01) |

(52) U.S. Cl.

CPC ..... *E21B 19/006* (2013.01); *B63B 35/4413* (2013.01); *B63B 2021/005* (2013.01); *E21B 19/09* (2013.01)

(58) Field of Classification Search

CPC . E21B 19/006; B63B 2021/005; B63B 21/02; B63B 21/50

USPC ..... 166/355

See application file for complete search history.

(56) References Cited

U.S. PATENT DOCUMENTS

| | | | | |
|---|---|---|---|---|
| 8,265,811 | B2 * | 9/2012 | Kyllingstad | G05D 1/0208 701/21 |
| 8,347,982 | B2 * | 1/2013 | Hannegan | E21B 21/08 175/5 |
| 8,640,790 | B2 * | 2/2014 | MacDougall | E21B 7/128 175/7 |
| 2007/0272906 | A1 * | 11/2007 | Davidson | B66D 1/525 254/270 |
| 2012/0031622 | A1 * | 2/2012 | Carlsen | E21B 17/085 166/355 |

(Continued)

*Primary Examiner* — Frederick L Lagman

(74) *Attorney, Agent, or Firm* — Matthias Scholl P.C.; Matthias Scholl

(57) ABSTRACT

A passive heave compensator, including an elastic cable, an electromagnetic damping device, a cylindrical sector, and a disc damping plate. The electromagnetic damping device includes a first cylinder including a helical coil, a permanent magnet mechanism disposed in the first cylinder, a first cover plate, a second cover plate, a first sliding shaft, a second sliding shaft, a first spring, a second spring, a first end cover, and a second end cover. The cylindrical sector includes a roof plate, a middle plate, a base plate, a first side plate, a second side plate, and a curved plate. The disc damping plate is disposed around the middle plate of cylindrical sector. The elastic cable is directly connected to the electromagnetic damping device. The electromagnetic damping device is disposed in the central part of the cylindrical sector. The middle plate is disposed between the roof plate and the base plate.

6 Claims, 3 Drawing Sheets

(56) References Cited

U.S. PATENT DOCUMENTS

| | | | | |
|---|---|---|---|---|
| 2015/0176347 | A1* | 6/2015 | Bansal | E21B 33/1292 166/341 |
| 2015/0285037 | A1* | 10/2015 | Sadiq | B66C 23/52 166/355 |
| 2015/0362039 | A1* | 12/2015 | Cannell | F16F 9/535 188/267.2 |
| 2017/0321499 | A1* | 11/2017 | Eriksen | E21B 19/006 |
| 2018/0016120 | A1* | 1/2018 | Bergem | B66C 23/52 |
| 2020/0318708 | A1* | 10/2020 | Ankargren | F16F 9/19 |

* cited by examiner

PASSIVE HEAVE COMPENSATOR

CROSS-REFERENCE TO RELATED APPLICATIONS

Pursuant to 35 U.S.C. § 119 and the Paris Convention Treaty, this application claims foreign priority to Chinese Patent Application No. 201910909820.5 filed Sep. 25, 2019, the contents of which, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND

The disclosure relates to a passive heave compensator (PHC).

Passive heave compensation is a technique used to reduce the influence of waves upon lifting and drilling operations. The main principle in PHC is to store the energy from the external forces such as waves and dissipate them or reapply them later.

SUMMARY

The disclosure provides a passive heave compensator, which comprises an elastic cable, an electromagnetic damping device, a cylindrical sector, and a disc damping plate. The electromagnetic damping device comprises a first cylinder comprising a helical coil, a permanent magnet mechanism disposed in the first cylinder, a first cover plate, a second cover plate, a first sliding shaft, a second sliding shaft, a first spring, a second spring, a first end cover, and a second end cover. The cylindrical sector comprises a roof plate, a middle plate, a base plate, a first side plate, a second side plate, and a curved plate. The disc damping plate is disposed around the middle plate of cylindrical sector.

The elastic cable is directly connected to the electromagnetic damping device; the electromagnetic damping device is disposed in a central part of the cylindrical sector; the middle plate is disposed between the roof plate and the base plate, thereby dividing the cylindrical sector into a two-layered structure; the first side plate shares one end with the second side plate, and another ends of the first side plate and the second side plate are connected to the curved plate; the permanent magnet mechanism comprises a second cylinder, and a plurality of permanent magnets disposed in the second cylinder with identical polar directions; two ends of the permanent magnet mechanism are sealed by the first cover plate and the second cover plate, respectively the first cover plate comprises a first mounting hole and the first sliding shaft is disposed in the first mounting hole; the second cover plate comprises a second mounting hole and the second sliding shaft is disposed in the second mounting hole; the first spring and the first end cover are wrapped around the first sliding shaft and the first end cover is disposed on the first spring; and the first end cover is fixedly connected to the first cylinder; the second spring and the second end cover are wrapped around the second sliding shaft and the second end cover is disposed on the second spring; and the second end cover is fixedly connected to the second cylinder; and two ends of the first cylinder are provided with a first through hole and a second through hole, respectively, and an energy storage module is disposed between the first through hole and the second through hole and electrically connected to the helical coil.

The first cylinder is fixedly connected to the cylindrical sector.

The roof plate comprises a first hole, the middle plate comprises a second hole, the first side plate comprises a third hole, and the curved plate comprises a fourth hole.

The included angle between the first side plate and the second side plate is 15-60 degrees.

The disc damping plate comprises a surface provided with a first reinforcing rib and a flange.

The disc damping plate comprises a surface provided with a second reinforcing rib abutting against the cylindrical sector.

Figure 1:
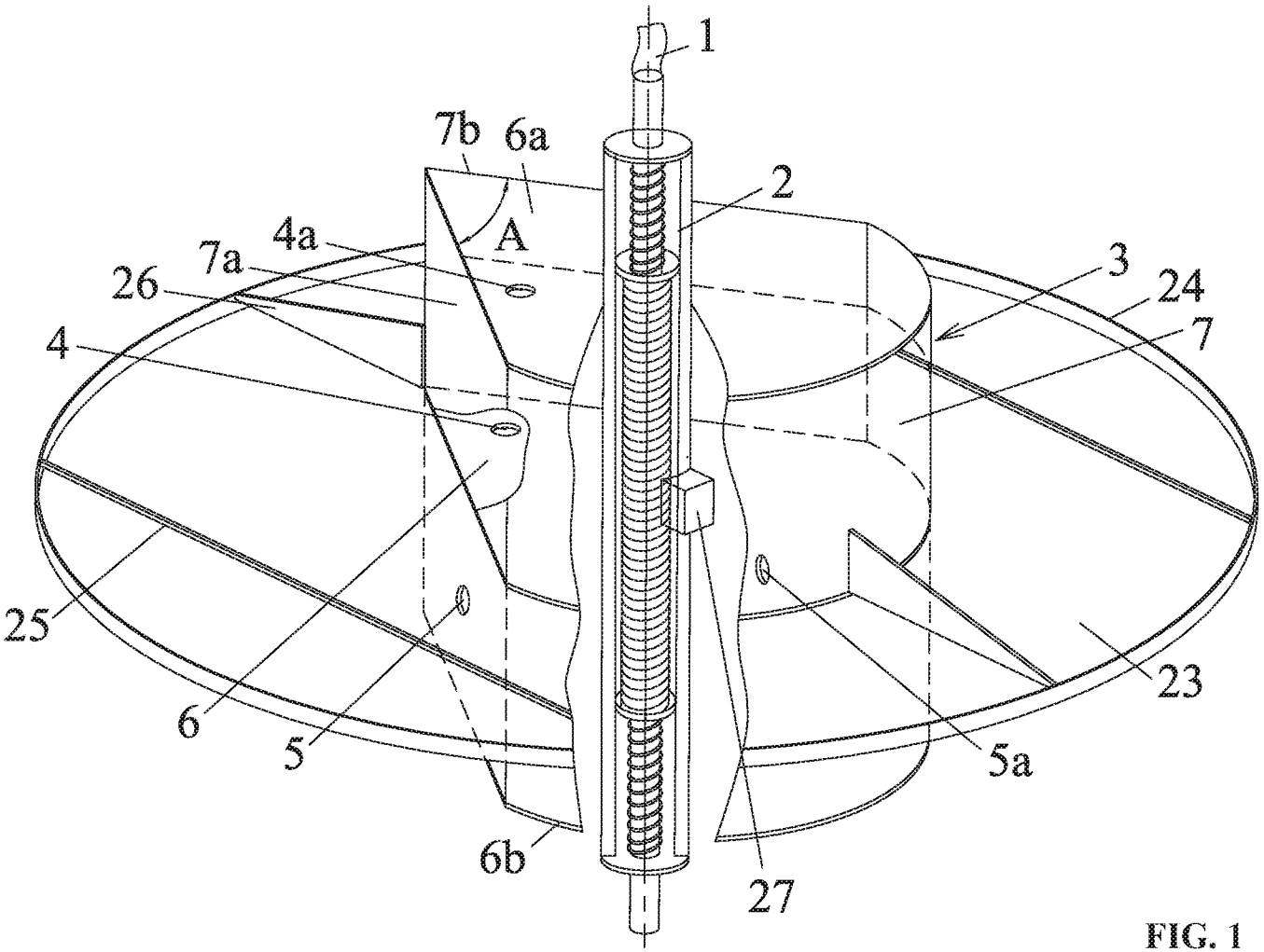
FIG. 1 is a perspective view of a passive heave compensator according one embodiment of the disclosure.

In the drawings, the following reference numbers are used: 1. Elastic cable 2. Electromagnetic damping device; 3. Cylindrical sector; 4. Second hole; 4*a*. First hole; 5. Third hole; 5*a*. Fourth hole; 6. Middle plate; 6*a*. Roof plate; 6*b*. Base plate; 7. Curved plate; 7*a*. First side plate; 7*b*. Second side plate; 8. First sliding shaft; 9. First end cover; 10. First spring; 11. First cylinder; 12. Permanent magnets; 13. Second spring; 14. Second end cover; 15. Second sliding shaft; 16. First through hole; 17. Second through hole; 18. Second cylinder; 19. First cover plate; 20. Second cover plate; 21. First mounting hole; 22. Second mounting hole; 23. Disc damping plate; 24. Flange; 25. First reinforcing rib; 26. Second reinforcing rib 27. Energy storage module.

BRIEF DESCRIPTION OF THE DRAWINGS

To further illustrate, embodiments detailing a passive heave compensator are described below. It should be noted that the following embodiments are intended to describe and not to limit the disclosure.

FIG. 1 is a perspective view of a passive heave compensator comprising an elastic cable 1, an electromagnetic damping device 2, and a cylindrical sector 3. The electromagnetic damping device 2 is disposed in the center of the cylindrical sector 3, and connected to the elastic cable 1.

The elastic cable 1 can be a polymer elastic cable, or other devices that convert an excitation of vibration to an elastic potential energy through elastic deformation thereof. The elastic cable 1 can be made of polymer elastic material comprising a plurality of elastic yarns. The elastic cable can be prepared through modular production where an elastic cable having a particular length and thickness is used as a module. According to the specific situation of submerged buoys, a plurality of elastic cables can be combined in series or in parallel to meet the requirements for the stiffness coefficient and the stretch ratio of the elastic cables.

The cylindrical sector 3 comprises a roof plate 6*a*, a middle plate 6, abase plate 6*b*, a curved plate 7, a first side plate 7*a*, and a second side plate 7*b*. The middle plate 6 is disposed between the roof plate 6*a* and the base plate 6*b*, thereby dividing the cylindrical sector into a two-layered structure; the first side plate 7*a* shares one end with the second side plate 7*b*, and another ends of the first side plate 7*a* and the second side plate 7*b* are connected to the curved plate 7. A disc damping plate 23 is disposed around the middle plate 6 of the cylindrical sector 3. The disc damping plate 23 comprising a flange 24, a first reinforcing rib 25, and a second reinforcing rib 26. The flange 24 is disposed around the outer edge of the disc damping plate 23, and the first reinforcing rib 25 is disposed on the surface of the disc damping plate 23, and the second reinforcing rib 26 is disposed between the cylindrical sector 3 and the disc damping plate 23. The roof plate 6*a* comprises a first hole 4*a*, and the middle plate 6 comprises a second hole 4, and the first side plate 7*a* comprises a third hole 5, and the curved plate 7 comprises a fourth hole 5*a*. All of the holes are configured to maintain the consistency of pressure between the inside and outside of the cylindrical sector 3. The included angle A between the first side plate 7*a* and the second side plate 7*b* is 60 degrees.

Figure 2:
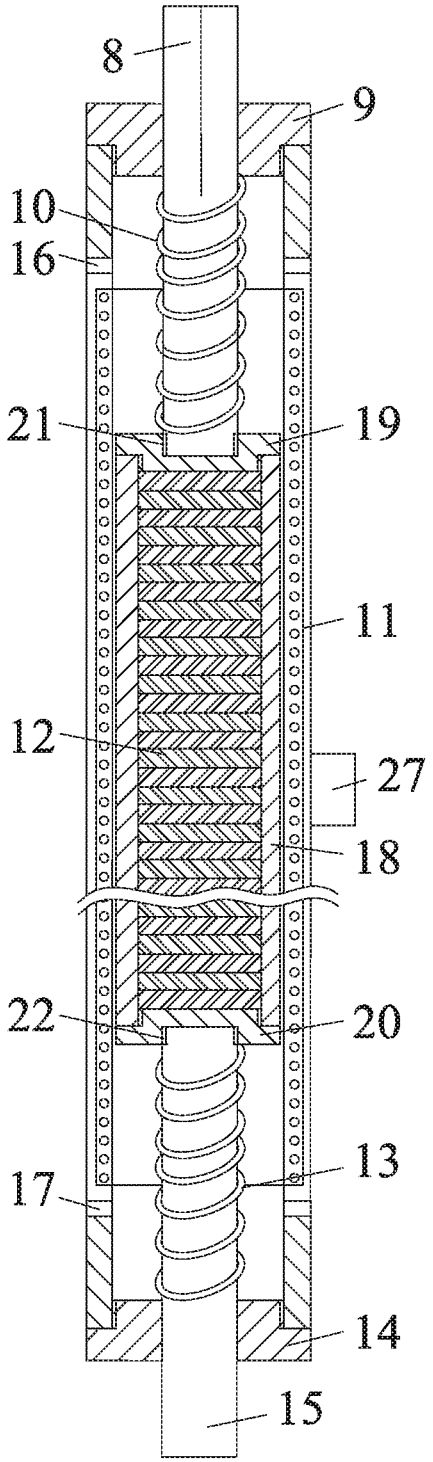
FIG. 2 is a schematic diagram of an electromagnetic damping device according one embodiment of the disclosure.

FIG. 2 is a schematic diagram of an electromagnetic damping device. The electromagnetic damping device comprises a first cylinder 11 and a permanent magnet mechanism. The first cylinder 11 comprises a helical coil. The permanent magnet mechanism comprises a second cylinder 18 comprising two threads on both ends thereof, a plurality of permanent magnets 12 disposed in the second cylinder 18 with identical polar directions. Two ends of the permanent magnet mechanism are sealed by a first cover plate 19 and a second cover plate 20, respectively. The first cover plate 19 comprises a first mounting hole 21 and the first sliding shaft 8 is disposed in the first mounting hole 21. The second cover plate 20 comprises a second mounting hole 22 and the second sliding shaft 15 is disposed in the second mounting hole 22. The first spring 10 and the first end cover 9 are wrapped around the first sliding shaft 8 and the first end cover is disposed on the first spring; and the first end cover 9 is fixedly connected to the first cylinder 11. The second spring 13 and the second end cover 14 are wrapped around the second sliding shaft 15 and the second end cover is disposed on the second spring; and the second end cover 14 is fixedly connected to the second cylinder 18. Two ends of the first cylinder 11 are provided with a first through hole 16 and a second through hole 17, respectively, and an energy storage module 27 is disposed between the first through hole 16 and the second through hole 17 and electrically connected to the helical coil. The first cylinder 11 is fixedly connected to the cylindrical sector 3.

The first spring 10 and the second spring 13 comprise stainless steel or other elastic materials resistant to corrosion, which are stable in seawater and resistant to seawater corrosion.

The helical coil of the first cylinder 11 can be a single coil or a plurality of coils. The frame of the first cylinder 11 can be polymer insulating materials with an insulating and anti-corrosive coating. The surfaces of the frame and the helical coil are coated with a layer of insulating and anti-corrosive material which is immune to seawater corrosion.

The plurality of permanent magnets 12 comprises a plurality of laminated magnetic steel sheets in the identical polar directions, and the gap between the magnetic steel sheets are filled with epoxy resin gasket. The plurality of the magnetic steel sheets and the epoxy resin gasket are placed in the second cylinder 18, thus producing the magnet field lines perpendicular to the surface of the permanent magnets 12.

The second cylinder 18 comprises a polymer material, or an austenitic stainless steel, which is not magnetic and has a tensile strength, with little effect on the magnetic field of the permanent magnets 12. The material is stable in seawater and resistant to seawater corrosion.

When no excitations of vibration occur, the first spring 10 and the second spring 13 keep the permanent magnets 12 in their original positions, thus being ready to produce an effective damping stroke to generate an electromagnetic damping when an excitation of vibration occurs.

When the excitation of vibration occurs and applies to the permanent magnetic mechanism, the permanent magnetic mechanism is driven by the excitation to move, partly offsetting the excitation. The rest excitation is then transmitted to the first spring 10 and the second spring 13 which convert the rest excitation to an elastic potential energy. The working mechanism avoids the first end cover 19 and the second end cover 14 from colliding with the permanent magnets when the electromagnetic damping cannot completely offset a relatively high excitation of vibration, thereby avoiding excessive vibration and preventing structural damage to the equipment. The elastic potential energy converted by the first spring 10 and the second spring 13 is continually released to the first end cover 9 and the second end cover 14 which constrain the translational motion of the sliding shaft in the horizontal plane (two degrees of freedom) while allowing the permanent magnet mechanism to move only in the vertical direction in the first cylinder 11. The first through hole 16 and the second through hole 17, which are disposed on both ends of the first cylinder 11, balance the internal and external pressure of the first cylinder 11.

Figure 3:
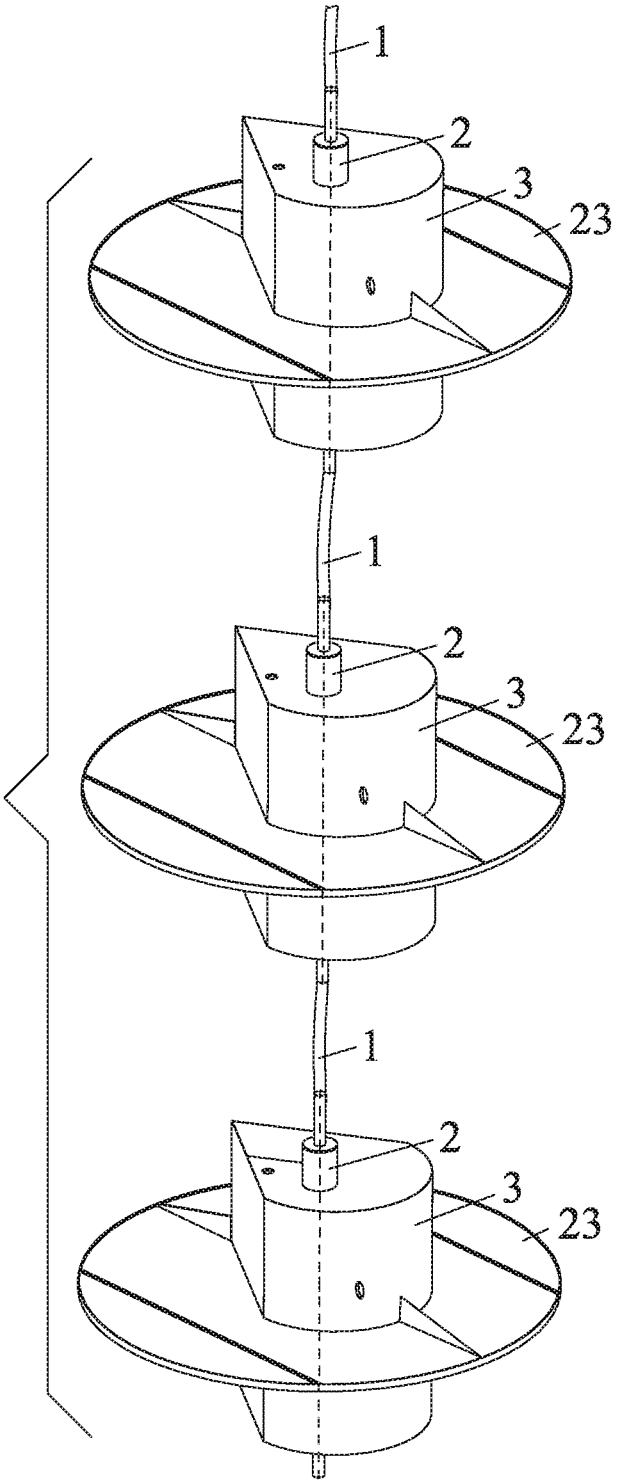
FIG. 3 is a schematic diagram of three passive heave compensators connected in series.

The cylindrical sector 3 is filled with water thereby increasing the inertial force of the cylindrical sector 3. A plurality of the cylindrical sector 3 connected in series can increase the damping effect, as shown in FIG. 3, three cylindrical sectors are connected in series.

The permanent magnet mechanism vertically moves in the first cylinder 11, and the magnetic field moves accordingly. The first cylinder 11 is immobilized. The helical coil cuts through the magnetic lines of the changing magnetic field to induce a current which produces a new magnetic field preventing the movement of the permanent magnet mechanism, thus forming a damping effect.

The electrical energy generated in the electromagnetic damping device 2 is recovered by the energy storage module, and further supplied to a surface buoy or a submerged buoy, to an external resistor or the first cylinder for short-circuit power consumption.

The passive heave compensator provides a stable working environment for the submerged buoy regardless of the water depth, and reduce the operation costs, facilitating the release of the submerged buoy.

It will be obvious to those skilled in the art that changes and modifications may be made, and therefore, the aim in the appended claims is to cover all such changes and modifications.

What is claimed is:

1. A device, comprising:

an elastic cable;

an electromagnetic damping device, the electromagnetic damping device comprising a first cylinder comprising a helical coil, a permanent magnet mechanism disposed in the first cylinder, a first cover plate, a second cover plate, a first sliding shaft, a second sliding shaft, a first spring, a second spring, a first end cover, and a second end cover;

a cylindrical sector, the cylindrical sector comprising a roof plate, a middle plate, a base plate, a first side plate, a second side plate, and a curved plate; and a disc damping plate disposed around the middle plate of cylindrical sector;

wherein:

the elastic cable is directly connected to the electromagnetic damping device;

the electromagnetic damping device is disposed in a central part of the cylindrical sector;

the middle plate is disposed between the roof plate and the base plate, thereby dividing the cylindrical sector into a two-layered structure; the first side plate shares one end with the second side plate, and another ends of the first side plate and the second side plate are connected to the curved plate;

the permanent magnet mechanism comprises a second cylinder, and a plurality of permanent magnets disposed in the second cylinder with identical polar directions;

two ends of the permanent magnet mechanism are sealed by the first cover plate and the second cover plate, respectively;

the first cover plate comprises a first mounting hole and the first sliding shaft is disposed in the first mounting hole;

the second cover plate comprises a second mounting hole and the second sliding shaft is disposed in the second mounting hole;

the first spring and the first end cover are wrapped around the first sliding shaft and the first end cover is disposed on the first spring; and the first end cover is fixedly connected to the first cylinder;

the second spring and the second end cover are wrapped around the second sliding shaft and the second end cover is disposed on the second spring; and the second end cover is fixedly connected to the second cylinder; and two ends of the first cylinder are provided with a first through hole and a second through hole, respectively, and an energy storage module is disposed between the first through hole and the second through hole and is electrically connected to the helical coil.

2. The device of claim 1, wherein the first cylinder is fixedly connected to the cylindrical sector.

3. The device of claim 1, wherein the roof plate comprises a first hole, the middle plate comprises a second hole, the first side plate comprises a third hole, and the curved plate comprises a fourth hole.

4. The device of claim 1, wherein an included angle between the first side plate and the second side plate is 15-60 degrees.

5. The device of claim 1, wherein the disc damping plate comprises a surface provided with a first reinforcing rib and a flange.

6. The device of claim 1, wherein the disc damping plate comprises a surface provided with a second reinforcing rib abutting against the cylindrical sector.

* * * * *